US005881822A

United States Patent [19]

Sienkiewycz et al.

[11] Patent Number: 5,881,822

[45] Date of Patent: Mar. 16, 1999

[54] PNEUMATIC TOOL AND VIBRATION ISOLATOR THEREFOR

[75] Inventors: Robert A. Sienkiewycz, Hamilton, N.Y.; Robert J. Michael, Erie, Pa.

[73] Assignees: Chicago Pneumatic Tool Company, Rock Hill, S.C.; The Lord Corporation, Cary, N.C.

[21] Appl. No.: 890,961

[22] Filed: Jul. 8, 1997

Related U.S. Application Data

[63] Continuation of Ser. No. 585,213, Jan. 11, 1996, abandoned.

[51] Int. Cl.[6] ..... B25D 17/24

[52] U.S. Cl. ..... 173/162.2; 173/168; 173/211; 173/DIG. 2

[58] Field of Search ..... 173/162.1, 162.2, 173/210, 211, 168, 169, 171; 30/381, 383

[56] References Cited

U.S. PATENT DOCUMENTS

| | | | |
|---|---|---|---|
| 2,058,583 | 10/1936 | Forss . | |
| 2,500,036 | 3/1950 | Horvath . | |
| 2,831,463 | 4/1958 | Ekstrom et al. . | |
| 3,372,759 | 3/1968 | Uebel | 173/162.1 |
| 3,525,373 | 8/1970 | Kabayashi | 173/162.1 |
| 3,968,843 | 7/1976 | Shotwell | 173/210 |
| 4,401,167 | 8/1983 | Sekizawa et al. . | |
| 4,611,671 | 9/1986 | Hansson | 173/162.2 |
| 4,643,263 | 2/1987 | Karden | 173/168 |
| 4,867,366 | 9/1989 | Kleinholz . | |
| 4,936,394 | 6/1990 | Ohtsu | 173/162.2 |
| 5,027,910 | 7/1991 | Honsa et al. | 173/162.2 |
| 5,050,689 | 9/1991 | Dobry et al. | 173/162.2 |
| 5,052,500 | 10/1991 | Ohtsu | 173/162.2 |
| 5,157,807 | 10/1992 | Keller et al. | 173/162.2 |
| 5,213,167 | 5/1993 | Best et al. | 173/162.2 |
| 5,322,131 | 6/1994 | Pressley et al. . | |
| 5,453,577 | 9/1995 | Everett et al. . | |

FOREIGN PATENT DOCUMENTS

| | | |
|---|---|---|
| 0207034 | 12/1986 | European Pat. Off. . |
| WO94/16864 | 8/1994 | WIPO . |

*Primary Examiner*—Scott A. Smith

*Attorney, Agent, or Firm*—Schmeiser, Olsen & Watts & Watts

[57] ABSTRACT

A pneumatic tool is disclosed which includes vibration mounts to reduce the amount of vibration transferred to the user. The vibration mounts include a pair of support members and at least one resilient vibration isolator connecting the support member in a spaced relationship. A compressed air conduit passes through the support member openings but is only directly fastened to one of the support members.

32 Claims, 3 Drawing Sheets

PNEUMATIC TOOL AND VIBRATION ISOLATOR THEREFOR

This application is a continuation of application Ser. No. 08/585,213, filed Jan. 11, 1996 now abandoned.

BACKGROUND OF THE INVENTION

1. Field of the Invention

This invention generally relates to vibration isolator mounts for pneumatic tools. In particular, this invention relates to a pneumatic tool vibration isolator mount adapted for mounting between the handle of a pneumatic tool and the tool housing to thereby reduce vibration.

2. Description of Relevant Art

Various problems associated with arriving at a vibratory isolator for use with a power tool include where to place the vibratory isolator in the tool and how to manufacture it so that it can withstand the intense vibrations involved with such a tool. The isolator must separate the tool into two pieces such that one can move relative to the other to therefore minimize the transfer of vibration. Difficulties arise in that the vibration isolator mount must also be strong enough to hold the two pieces together and, in the case of pneumatic tools, allow compressed air to pass therethrough.

U.S. Pat. No. 5,453,577 issued to Everett et al. on Sep. 26, 1995 entitled "Pneumatic Tool and Vibration Isolator Mounts Therefor" teaches vibration mounting devices between the handle of a pneumatic tool and the tool housing. In particular, the patent teaches placing a resilient vibration isolator between two support members and then passing a compressed air conduit therebetween. To achieve reduced vibration, the support members' openings remain sealed to the compressed air conduit while the vibration isolators themselves remain spaced from the conduit.

Although the aforementioned patent provides an improved system of locating vibration dampening mounts, it incorporates numerous parts. Thus, a simplified vibration isolator system for mounting between a tool handle and housing is desirable which will produce the same or better vibration dampening results. The above-mentioned relevant art is hereby incorporated by reference.

SUMMARY OF THE INVENTION

The present invention provides a pneumatic tool with vibration isolator mounts for mounting between a handle of the pneumatic tool and the tool housing to reduce the amount of vibration. The vibration mount in particular utilizes a first and second support member each having an opening with a compressed air conduit running therethrough. The second support member utilizes a sleeved opening that does not come in contact with the compressed air conduit. Placed between the two support members is a vibration isolator. The vibration isolator covers the interior surface of the sleeved opening and directly contacts the compressed air conduit. The vibration isolator also includes a gap dividing the vibration isolator into an inner portion and an outer portion such that the inner portion is secured to the compressed air conduit and the outer portion separates the two support members in a spacial relationship. The gap also separates the sleeved opening from the compressed air conduit. This simplified system reduces the number of parts by about 75% and therefore substantially reduces the cost of assembly.

In accordance with the above, it is an advantage of the present invention to provide a vibration isolator mount for mounting between the handle of the pneumatic tool and the tool housing to thereby reduce vibration transferred to the user.

In accordance with the above, it is a further advantage of the present invention to provide a vibration isolator mount which reduces the number of parts required.

In accordance with the above, it is a further advantage of the present invention to provide a vibration isolator mount that is inexpensive to manufacture.

In accordance with the above, it is a further advantage of the present invention to provide a vibration isolator mount through which an air conduit may pass.

The foregoing and other features and advantages of the invention will be apparent from the following more particular description of a preferred embodiment of the invention, as illustrated in the accompanying drawings.

BRIEF DESCRIPTION OF DRAWINGS

The preferred exemplary embodiment of the present invention will hereinafter be described in conjunction with the appended drawings where like designations denote like elements, and.

DETAILED DESCRIPTION OF THE PREFERRED EMBODIMENT

Figure 1:
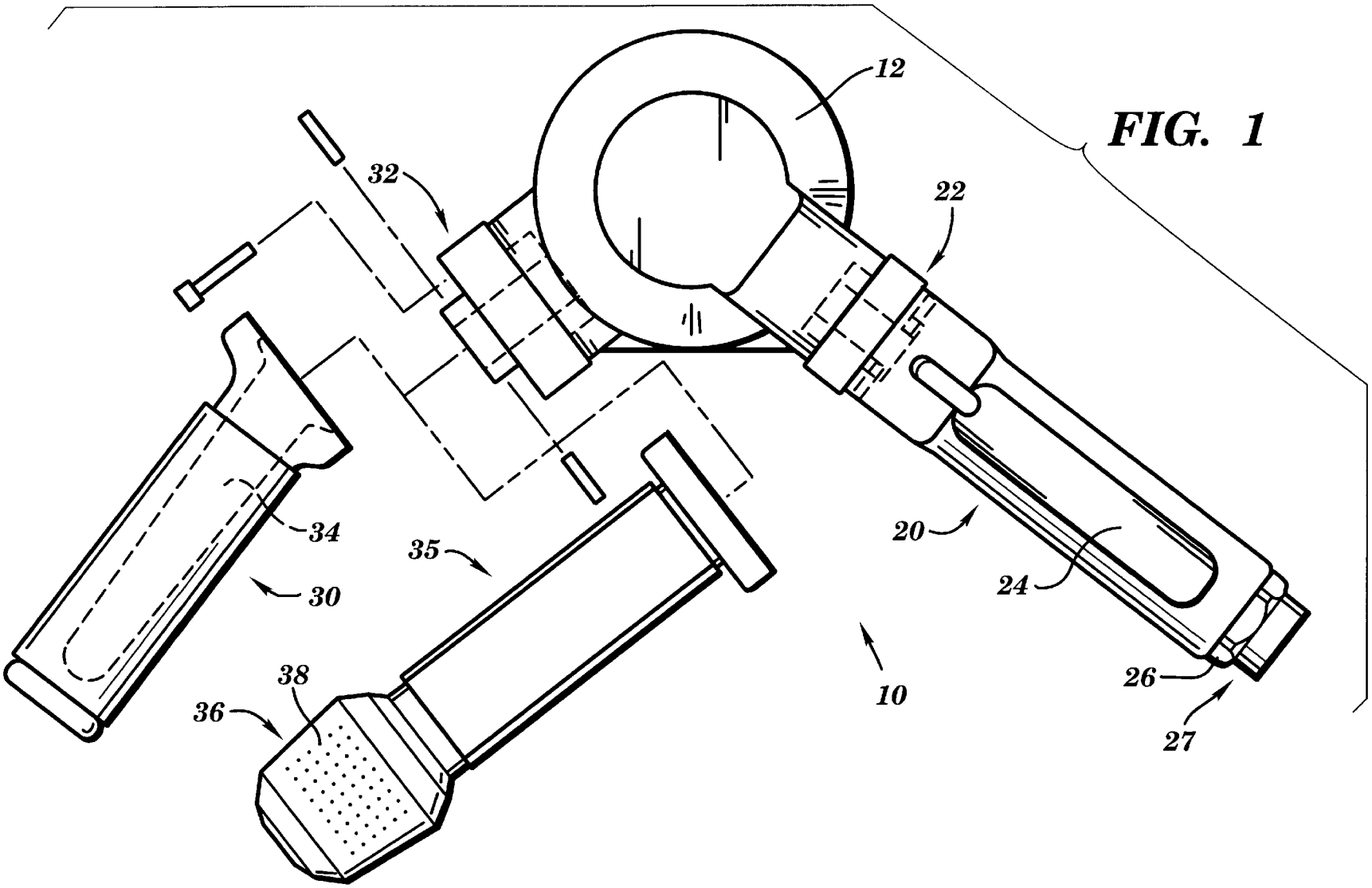
FIG. 1 is a top view of a pneumatic tool illustrating a plurality of vibration isolator mounts of a preferred embodiment of the present invention for isolating one of a plurality of handles from a vibratory source on a pneumatic tool.

FIG. 1 illustrates a top view of a pneumatic tool 10 such as a grinder, sander or polisher. The tool 10 includes a housing 12, a throttle handle 20, and a support handle 30. Optionally, the support handle 30 may be substituted for a support handle 35 with a muffler 36 extending therefrom. The throttle handle 20 is attached to the body of the housing 12 by throttle handle vibration isolator mount 22 and the support handle 30 is attached to the housing 12 by support handle vibration isolator mount 32.

An air hose (not shown) is coupled to the end of the throttle handle 20 at inlet bushing 27. The inlet bushing 27 includes a tool engagement surface 26 such as a hex surface. The tool engagement surface 26 are proximate male threads (internal of handle 20 in FIG. 1) for coupling the inlet bushing 27 into the handle 20. Concentrically internal of the inlet bushing 27 are female threads for coupling an air hose to the handle 20. During operation, air passes through handle 20 via air passage 24 and then through the throttle handle vibration isolator mount 22 into a pneumatic motor inside the housing 12. Air is expelled from the motor in housing 12 into the air passage 34 in support handle 30 via support handle vibration isolator mount 32. Air from the air passage 34 then returns into the housing 12 where it is eventually expelled through an outlet (not shown) in the housing 12.

Optionally, a support handle 35 with a muffler 36 may be attached to the housing 12. The foraminous openings 38 in the muffler 36 expel air that has passed through air passage 34.

Figure 2:
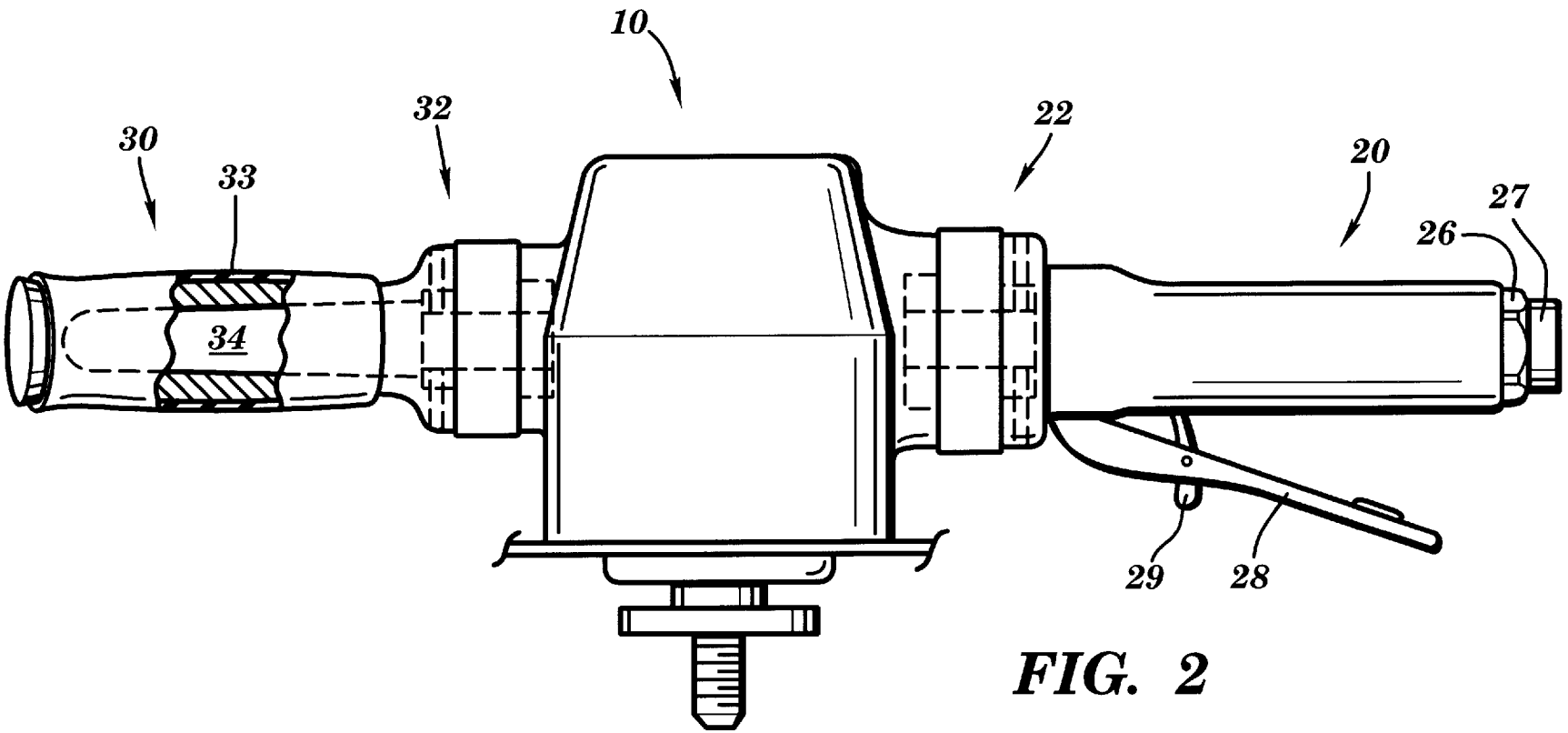
FIG. 2 is a side view of a pneumatic tool illustrating a plurality of vibration isolator mounts of a preferred embodiment of the present invention for mounting handles to a pneumatic tool.

FIG. 2 depicts a side view of the pneumatic tool 10 of the present invention. The pneumatic tool 10 includes a throttle lever 28 having a lock 29 thereon. The lock acts as a safety feature to prevent unintended operation of the tool 10. The support handle 30 also includes a handle grip 33 made of material such as foam rubber to enhance frictional grip of the user during use of the pneumatic tool 10.

Figure 3:
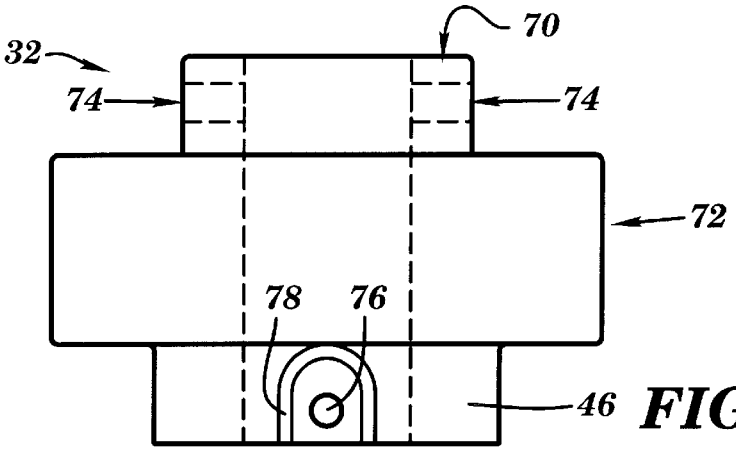
FIG. 3 is a side view of a vibration isolator mount of a preferred embodiment of the present invention.

FIG. 3 shows a side view of the handle vibration isolator mount 32. The mount 32 includes the following: a conduit extension sleeve 70, suitable for attachment to a tool handle; a tubular sleeved opening 46, suitable for attachment to a tool housing; and a vibration isolator body 72, suitable for reducing vibration from the tool housing to the tool handle. In the preferred embodiment, attachment of the isolator mount 32 to the tool housing is accomplished with bolts or the like (see FIG. 6), and attachment of the mount 32 to the tool handle is accomplished with pins that mount, for example, into cavity 74. The tubular sleeved opening 46 may include a hole 76 and a U-shaped clearance groove 78 suitable for holding a roll pin for use as a backup safety mechanism. Preferably, the entire mount is manufactured into a single self-contained unit suitable for easy installation or replacement.

Figure 4:
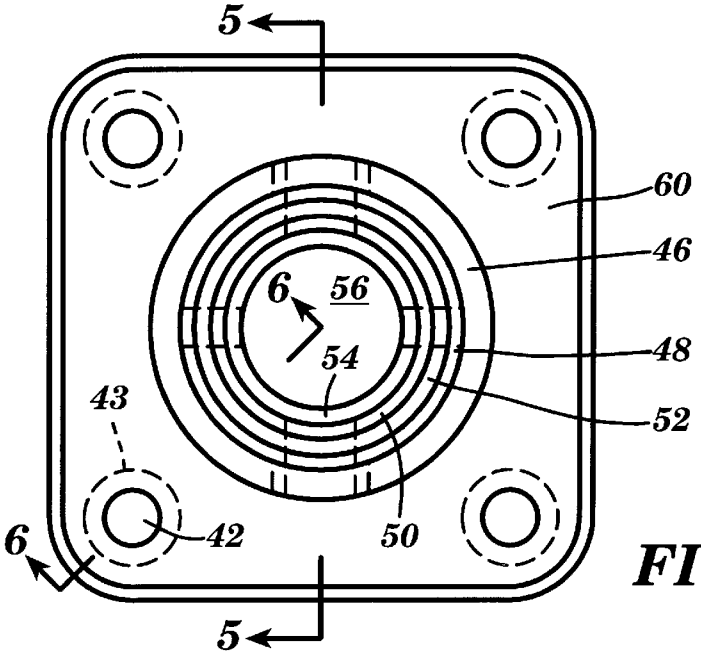
FIG. 4 is a front view of a vibration isolator mount of a preferred embodiment of the present invention.

FIG. 4 shows a front view of the support handle vibration isolator mount 32. The mount 32 includes a mounting plate or a support member 60 having a compressed air passage 56 and mounting holes 42 therein. On the opposite side of support member 60, a vibration isolator is attached thereto (see FIG. 5). Centrally located on support member 60 is sleeved opening 46 which projects orthogonally toward the viewer from mounting plate 60 (see FIG. 5). An outer portion 48 of the vibration isolator and an inner portion 50 of the vibration isolator also extend orthogonally toward the viewer interior to the sleeved opening 46. The outer and inner portions 48 and 50 of the vibration isolator are separated by a gap 52 positioned therebetween. The inner portion of the vibration isolator 50 is secured to the exterior surface of compressed air conduit 54. Preferably, the inner portion of vibration isolator 50 will be sealed in a fixed manner to compressed air conduit 54 and outer vibration isolator 48 will be sealed in a fixed manner to sleeved opening 46. Mounting holes 42 provide a passage means for a bolt or the like to pass through and secure the mount 32 to the tool housing (see FIG. 6).

Figure 5:
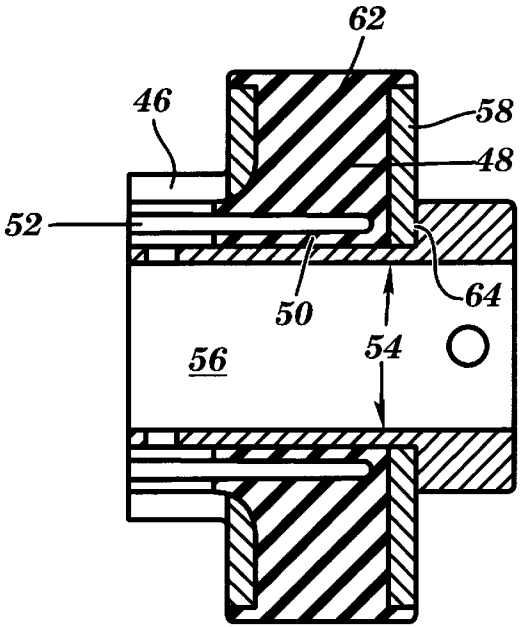
FIG. 5 is a side sectional view of a throttle vibration isolator mount of a preferred embodiment of the present invention as taken through section 5—5 of FIG. 4.

Referring now to FIG. 5, a sectional side view of support handle vibration isolator mount 32 is depicted as taken through section line 5—5 of FIG. 4. The sectional view shows first and second mounting plates or support members 58 and 60 with a vibration isolator 62 having first and second lateral surfaces secured therebetween. The support members 58 and 60, and the vibration isolator 62 are situated about the circumference of compressed air conduit 54. Compressed air conduit 54 has a compressed air passage 56 that includes a substantially uniform opening therein for the passage of compressed air. In the preferred embodiment, the vibration isolator material utilizes injection molding or some other similar process to "fuse" the vibration isolator to the support members and compressed air conduit. It is recognized however that any other means for maintaining placement of these parts (e.g., grooves, notches, tight-fitting parts, glue, etc.) would be suitable. Moreover, it also envisioned that the compressed air conduit 54 and the first support member 58 could be forged or integrated from a single piece of material.

The second support member 60 includes a sleeved opening 46 which projects orthogonally away from the first support member 58. In the preferred embodiment, sleeved opening 46 is tubular in shape and is forged from the same piece of material as the second support member 60. However, it is recognized that sleeved opening 46 may have some other cross section (e.g. oval, rectangular, etc.) and it may be forged from an entirely separate piece of material than that of support member 60.

As previously noted, vibration isolator 62 includes an inner portion 50 and an outer portion 48 separated by gap 52. First support member 58 and inner vibration isolator 50 provide exclusive securement of mount 32 about compressed air conduit 54. To improve securement, compressed air conduit 54 may include a recessed edge 64 within which first support member 58 may be mounted.

In this preferred embodiment, the second support member 60 and its sleeve opening 46 do not directly contact the compressed air conduit 54. Rather, the gap 52 separates the second support member and its sleeved opening from the compressed air conduit 54. However, the interior surface of the sleeved opening 46 may have the outer portion of the vibration isolator material 48 affixed in a sealed or fused manner thereto (see FIG. 6). Additionally, the inner portion of the vibration isolator 50 may be sealed or fused to the compressed air conduit within the sleeved opening portion of vibration mount 32 (see FIG. 6).

Figure 6:
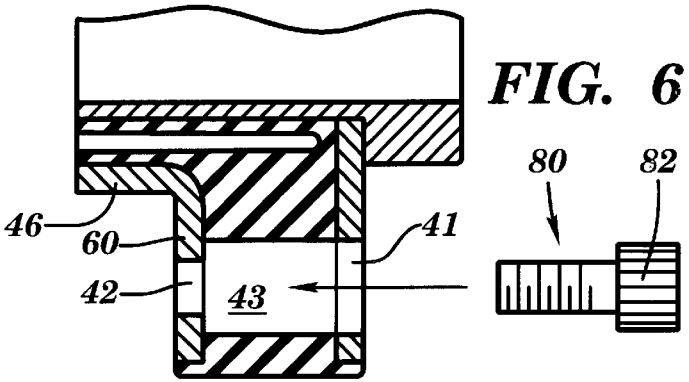
FIG. 6 is a sectional view of the vibration isolator mount of a preferred embodiment of the present invention as taken through section 6—6 of FIG. 4.

Referring now to FIG. 6, a second sectional side view of support handle vibration isolator mount 32 of the present invention is depicted as taken through section 6—6 of FIG. 4. FIG. 6 shows a first opening 41 through first support member 58 and a second opening 42 through second support member 60. Vibration isolator 62 includes a passageway 43 connecting first opening 41 and second opening 42. These holes and passage way provide a means for securing the vibration mount to a pneumatic tool housing. In particular, bolt 80 can be inserted through hole 41, into passageway 43, and extend through hole 42 such that the head of the bolt 82 fastens to the inside surface of second support member 60. Although this preferred embodiment discloses the use of bolts and pins as a securement means, any combination of bolts, rods, pins, screws, clamping devices or the like may be utilized.

It is further recognized that while the above disclosure is drawn closely to a vibration isolator mount for a support handle, it is meant to be generic for all types of mounts including a throttle handle vibration isolator mount. Moreover, it is further envisioned that this invention could be utilized on other locations within power tools. Although a pneumatic grinder, sander, or polisher 10 is illustrated, other types of rotary or reciprocating pneumatic tools may be used with the vibration isolator mounts such as a rotary handle, a hammer drill,. a drill, or the like. The embodiments disclosed herein have been discussed for the purpose of familiarizing the reader with the novel aspects of the invention. Although the preferred embodiments of the invention have been shown, many changes, modifications and substitutions may be made by one having ordinary skill in the art without necessarily departing from the spirit and scope of the invention as described in the following claims.

We claim:

1. A vibration mount for use with a pneumatic tool, said mount comprising:

a compressed air conduit having an inner surface and an outer surface;

a first support member situated around and in nonsliding contact with said outer surface of said compressed air conduit;

a second support member situated around and spaced from said outer surface of said compressed air conduit; and a vibration isolator mounted between said first and said second support members wherein said vibration isolator includes a gap that divides said vibration isolator into an inner portion that contacts said outer surface of said compressed air conduit and an outer portion that is spaced from said compressed air conduit.

2. The vibration mount of claim 1, wherein said vibration isolator extends concentrically around the outer surface of said compressed air conduit.

3. The vibration mount of claim 2, wherein said gap extends concentrically around the outer surface of said compressed air conduit.

4. The vibration mount of claim 1, wherein said second support member includes a tubular sleeve situated around and concentrically spaced from said compressed air conduit.

5. A vibration mount for use with a pneumatic tool, said mount comprising:

a compressed air conduit;

a first support member, said first support member situated around and in contact with said compressed air conduit;

a second support member, said second support member situated around and spaced from said compressed air conduit;

a vibration isolator situated around said compressed air conduit, said vibration isolator having a first surface in contact with said first support member and having a second surface in contact with said second support member; and a tubular sleeve connected to said second support member and concentrically spaced from said compressed air conduit, said tubular sleeve extending axially away from said second surface of said vibration isolator.

6. The vibration mount of claim 5, wherein said tubular sleeve includes an interior surface in contact with said vibration isolator.

7. The vibration mount of claim 5, wherein said vibration isolator includes a gap that divides said vibration isolator into an outer portion and an inner portion.

8. The vibration mount of claim 5, wherein said vibration isolator extends concentrically around an exterior surface of said compressed air conduit.

9. A vibration mount for use with a pneumatic tool, said vibration mount comprising:

a compressed air conduit;

a first support member, said first support member being situated around and in nonsliding contact with said compressed air conduit;

a second support member, said second support member being situated around and spaced from said compressed air conduit; and a vibration isolator placed concentrically around said compressed air conduit, said vibration isolator having a first lateral surface in contact with said first support member and having a second lateral surface in contact with said second support member.

10. The vibration mount of claim 9, further including a plurality of mounting holes extending through said first support member, said vibration isolator and said second support member.

11. The vibration mount of claim 9, wherein said vibration isolator includes a gap that divides said vibration isolator into an inner portion and an outer portion.

12. The vibration mount of claim 9, wherein said second support member includes a tubular sleeve concentrically spaced from said compressed air conduit.

13. A pneumatic tool comprising:

a housing;

a handle having a pneumatic air coupling; and a vibration mount for connecting said housing to said handle, said vibration mount including:

a compressed air conduit having an inner surface and an outer surface;

a first support member situated around and in nonsliding contact with said outer surface of said compressed air conduit;

a second support member situated around and spaced from said outer surface of said compressed air conduit; and a vibration isolator mounted between said first and said second support members wherein said vibration isolator includes a gap that divides said vibration isolator into an inner portion that contacts said outer surface of said compressed air conduit and an outer portion that is spaced from said compressed air conduit.

14. The pneumatic tool of claim 13 wherein said vibration isolator extends concentrically around the outer surface of said compressed air conduit.

15. The pneumatic tool of claim 14 wherein said gap extends concentrically around the outer surface of said compressed air conduit.

16. The pneumatic tool of claim 13 wherein said second support member includes a tubular sleeve concentrically spaced around said compressed air conduit.

17. A vibration mount for use with a pneumatic tool, said mount comprising:

a compressed air conduit having an inner surface and an outer surface;

a first support member situated around and in contact with said outer surface of said compressed air conduit;

a second support member situated around and spaced from said outer surface of said compressed air conduit;

a vibration isolator mounted between said first and said second support members wherein said vibration isolator includes a gap that divides said vibration isolator into an inner portion that contacts said outer surface of said compressed air conduit and an outer portion that is spaced from said compressed air conduit; and means for fastening the vibration mount to the pneumatic tool, the means for fastening extending through one of the support members, and at least a portion of the vibration isolator.

18. The vibration mount of claim 17, wherein said vibration isolator extends concentrically around the outer surface of said compressed air conduit.

19. The vibration mount of claim 18, wherein said gap extends concentrically around the outer surface of said compressed air conduit.

20. The vibration mount of claim 17, wherein said second support member includes a tubular sleeve situated around and concentrically spaced from said compressed air conduit.

21. A vibration mount for use with a pneumatic tool, said mount comprising:

a compressed air conduit;

a first support member, said first support member situated around and in contact with said compressed air conduit;

a second support member including a tubular sleeve concentrically spaced from said compressed air conduit and a radially outward portion extending radially from said tubular sleeve; and a vibration isolator situated around said compressed air conduit, said vibration isolator having a first surface in contact with said first support member and having a second surface in contact with said second support member.

22. The vibration mount of claim 21, wherein said tubular sleeve includes an interior surface in contact with said vibration isolator.

23. The vibration mount of claim 21, wherein said vibration isolator includes a gap that divides said vibration isolator into an outer portion and an inner portion.

24. The vibration mount of claim 21, wherein said vibration isolator extends concentrically around an exterior surface of said compressed air conduit.

25. A vibration mount for use with a pneumatic tool, said vibration mount comprising:

a compressed air conduit;

a first support member situated around and in contact with said compressed air conduit along a contact surface of said first support member;

a second support member situated around and spaced from said compressed air conduit; and a vibration isolator having a first surface in contact with said first support member, a second surface in contact with said second support member, and a third surface in contact with said compressed air conduit, and wherein said contact surface is shorter than said third surface.

26. The vibration mount of claim 25, further including a plurality of mounting holes extending through said first support member, said vibration isolator and said second support member.

27. The vibration mount of claim 25, wherein said vibration isolator includes a gap that divides said vibration isolator into an inner portion and an outer portion.

28. The vibration mount of claim 25, wherein said second support member includes a tubular sleeve concentrically spaced from said compressed air conduit.

29. A pneumatic tool comprising:

a housing;

a handle having a pneumatic air coupling; and a vibration mount for connecting said housing to said handle, said vibration mount including:

a compressed air conduit having an inner surface, an outer surface and a shoulder portion;

a first support member situated around and in contact with the shoulder portion of said outer surface of said compressed air conduit;

a second support member situated around and spaced from said outer surface of said compressed air conduit; and a vibration isolator mounted between said first and said second support members wherein said vibration isolator includes a gap that divides said vibration isolator into an inner portion that contacts said outer surface of said compressed air conduit and an outer portion that is spaced from said compressed air conduit.

30. The pneumatic tool of claim 29, wherein said vibration isolator extends concentrically around the outer surface of said compressed air conduit.

31. The pneumatic tool of claim 30, wherein said gap extends concentrically around the outer surface of said compressed air conduit.

32. The pneumatic tool of claim 29, wherein said second support member includes a tubular sleeve concentrically spaced around said compressed air conduit.

* * * * *